US009217972B2

(12) United States Patent
Taguchi et al.

(10) Patent No.: US 9,217,972 B2
(45) Date of Patent: Dec. 22, 2015

(54) FIXING DEVICE OF AN IMAGE FORMING APPARATUS

(71) Applicant: CANON KABUSHIKI KAISHA, Tokyo (JP)

(72) Inventors: Sho Taguchi, Fujisawa (JP); Masahiko Suzumi, Yokohama (JP); Masahito Omata, Yokohama (JP); Shoichiro Ikegami, Yokohama (JP); Takeharu Nakada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/657,561

(22) Filed: Mar. 13, 2015

(65) Prior Publication Data

US 2015/0261145 A1 Sep. 17, 2015

(30) Foreign Application Priority Data

Mar. 17, 2014 (JP) ..... 2014-054180

(51) Int. Cl.
*G03G 15/20* (2006.01)

(52) U.S. Cl.
CPC ..... *G03G 15/206* (2013.01)

(58) Field of Classification Search
CPC ..... G03G 15/2014; G03G 15/2046; G03G 15/2053; G03G 15/2057; G03G 15/2078; G03G 15/2082; G03G 15/206; G03G 15/2042; G03G 15/2039
See application file for complete search history.

(56) References Cited

U.S. PATENT DOCUMENTS

| | | | | |
|---|---|---|---|---|
| 5,499,087 | A * | 3/1996 | Hiraoka et al. | 399/329 |
| 2006/0153605 | A1* | 7/2006 | Nishiyama et al. | 399/329 |
| 2007/0059001 | A1* | 3/2007 | Matsuura et al. | 399/45 |
| 2008/0138131 | A1* | 6/2008 | Jung et al. | 399/329 |
| 2009/0230114 | A1* | 9/2009 | Taniguchi et al. | 219/216 |
| 2010/0104340 | A1* | 4/2010 | Kitadai et al. | 399/400 |
| 2010/0266306 | A1* | 10/2010 | Ohashi | 399/69 |
| 2012/0148273 | A1* | 6/2012 | Shimura et al. | 399/33 |
| 2013/0195494 | A1* | 8/2013 | Asami et al. | 399/70 |
| 2014/0037347 | A1* | 2/2014 | KIM et al. | 399/328 |
| 2014/0138372 | A1* | 5/2014 | Ogura | 219/216 |
| 2014/0169845 | A1* | 6/2014 | Nakahara et al. | 399/328 |
| 2014/0178112 | A1* | 6/2014 | Lee et al. | 399/329 |
| 2014/0186078 | A1* | 7/2014 | Imaizumi et al. | 399/329 |

(Continued)

FOREIGN PATENT DOCUMENTS

| | | | |
|---|---|---|---|
| JP | H07-199693 | A | 8/1995 |
| JP | H10-232576 | A | 9/1998 |
| JP | H11-84919 | A | 3/1999 |

*Primary Examiner* — Clayton E Laballe
*Assistant Examiner* — Ruifeng Pu
(74) *Attorney, Agent, or Firm* — Canon U.S.A., Inc. IP Division

(57) ABSTRACT

A fixing device includes a tubular film; a heater including a substrate and a heat generating resistor, the heater having a first region on which the heat generating resistor is formed and a second region, located outside of the first region in a longitudinal direction of the substrate, on which the heat generating resistor is not formed; and a heat conductive member configured to contact a surface of the heater opposite to a surface of the heater that contacts the film, the heat conductive member having a higher heat conductivity than the substrate. The heat conductive member contacts the heater in a region extending across the first region and the second region, and an amount of heat generated by the heat generating resistor at its end portion is greater than that at its middle portion in the longitudinal direction.

4 Claims, 9 Drawing Sheets

(56) References Cited

U.S. PATENT DOCUMENTS

2015/0023704 A1* 1/2015 Imaizumi et al. ..... 399/329
2015/0139707 A1* 5/2015 Suzumi et al. ..... 399/329
2015/0139708 A1* 5/2015 Shimura et al. ..... 399/329
2015/0153692 A1* 6/2015 Matsubara et al. ..... 399/329

* cited by examiner

FIXING DEVICE OF AN IMAGE FORMING APPARATUS

BACKGROUND OF THE INVENTION

1. Field of the Invention

The present invention relates to a fixing device of an image forming apparatus that uses an electrophotographic method or an electrostatic recording method. Examples of the image forming apparatus include printers, such as laser beam printers and LED printers, and digital copiers.

2. Description of the Related Art

A film is used in some fixing devices of electrophotographic image forming apparatuses. Typically, a fixing device of this type includes a film, a heater that is in contact with the film and that heats the film, and a backup member that is in contact with the film and that forms a nip for transporting a recording medium. The fixing device, which uses a film having a small heat capacity, requires only a short warm-up time and has a merit in that it can contribute to reduction of a first print out time (FPOT).

On the other hand, it is known that the fixing device using a film tends to cause a so-called "temperature rise of sheet-non-passing area", that is, a phenomenon in which the temperature of the sheet-non-passing area is increased considerably when a recording medium having a width smaller than the largest size (hereinafter referred to as a small-sized recording medium) is passed through the fixing device. In order to suppress the temperature rise of sheet-non-passing area, Japanese Patent Laid-Open No. 11-84919 describes a structure in which a metal plate is in contact with the heater.

With the structure described in Japanese Patent Laid-Open No. 11-84919, the temperature rise of sheet-non-passing area can be suppressed due to the function of the metal plate, which is in contact with the heater over the entire length of the heater. However, when warming up the fixing device, a decrease of the temperature of an end portion of the heater in the longitudinal direction (hereinafter referred to as "end portion temperature decrease") tends to occur. Due to the end portion temperature decrease, this structure has a problem in that, when fixing is performed on a recording medium having a large size, a fixing failure may occur at the end portion of the recording medium.

SUMMARY OF THE INVENTION

According to an embodiment of the present invention, there is provided a fixing device that fixes a toner image on a recording medium by heating the toner image while conveying the recording medium bearing the toner image at a nip. The fixing device includes a tubular film; a heater, including an elongate substrate and a heat generating resistor formed on the substrate, configured to contact the film, the heater having a first region on which the heat generating resistor is formed and a second region, located outside of the first region in a longitudinal direction of the substrate, on which the heat generating resistor is not formed; and a heat conductive member configured to contact a surface of the heater opposite to a surface of the heater that contacts the film, the heat conductive member having a heat conductivity higher than that of the substrate. The heat conductive member contacts the heater in a region extending across the first region and the second region, and an amount of heat generated by the heat generating resistor at an end portion thereof is greater than an amount of heat generated at a middle portion thereof in the longitudinal direction.

Further features of the present invention will become apparent from the following description of exemplary embodiments with reference to the attached drawings.

DESCRIPTION OF THE EMBODIMENTS

First Embodiment

Hereinafter, embodiments of the present invention will be described.

Image Forming Apparatus

Figure 1:
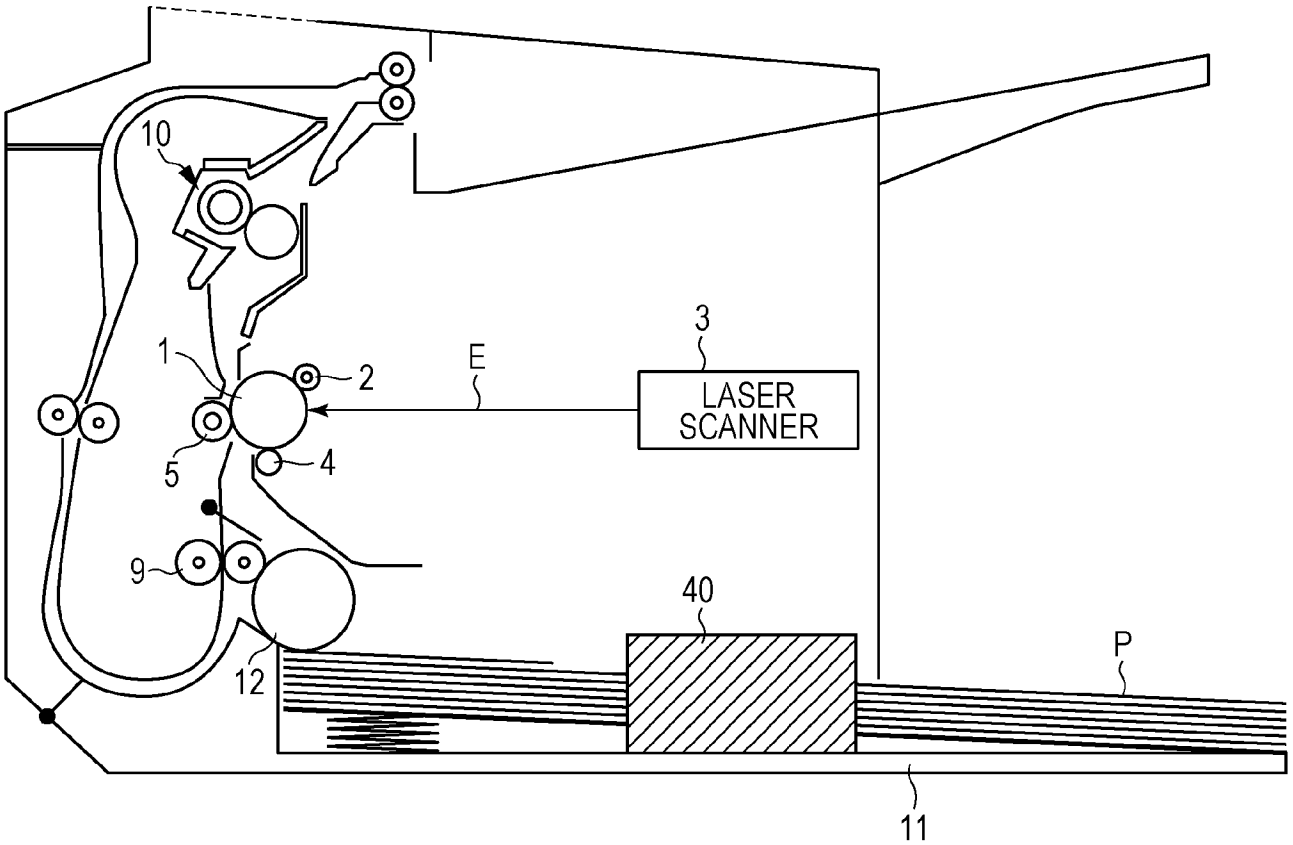
FIG. 1 is a schematic sectional view of an image forming apparatus according to a first embodiment.

As illustrated in FIG. 1, an image forming unit of a laser beam printer, which is an example of an image forming apparatus, includes a photoconductive drum 1; and a charger 2, a laser scanner 3, a developing unit 4, and a transfer roller 5, which are arranged in a direction in which the photoconductive drum 1 rotates. The image forming unit forms a toner image on a recording medium. The charger 2 charges the photoconductive drum 1, the laser scanner 3 forms an electrostatic latent image by exposing the photoconductive drum 1 to light, and the developing unit 4 develops the toner image by applying a toner to the electrostatic latent image formed on the photoconductive drum 1. The transfer roller 5 forms a transfer nip in cooperation with the photoconductive drum 1, and transfers the toner image on the photoconductive drum 1 to the recording medium at the transfer nip.

A recording medium P is fed from a sheet feed cassette 7 by a feed roller 6 and transported to the transfer nip. The sheet feed cassette 7 includes regulation plates 40 that regulate the positions of both ends of the recording medium in order to transport the recording medium at a predetermined position in the width direction. As described above, a toner image is transferred to the recording medium P, which has been transported to the transfer nip. Subsequently, the recording medium, on which the toner image has been formed, is transported to a fixing device 10, and the fixing device 10 fixes the toner image to the recording medium. Lastly, the recording medium, to which the toner image has been fixed, is output to the outside of the image forming apparatus. The above image forming process can be continuously performed on a plurality of recording media. A laser beam printer according to the present embodiment has a resolution of 600 dpi and a throughput of 40 pages/minute (letter-size longitudinal feed: process speed of about 222 mm/s).

Fixing Device

Figure 2:
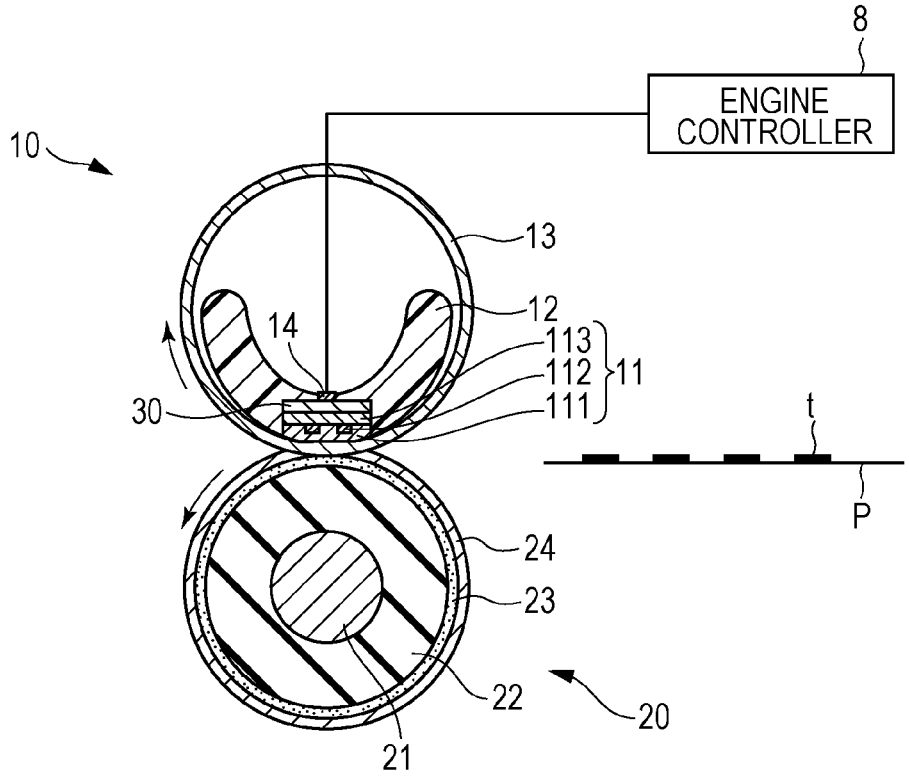
FIG. 2 is a schematic sectional view of a fixing device according to the first embodiment.

As illustrated in FIG. 2, the fixing device 10 includes a film 13 that has a tubular shape, a heater 11 that is elongate and that is in contact with an inner surface of the film 13, and a pressure roller 20 that forms a nip in cooperation with the heater 11 with the film 13 therebetween. The pressure roller 20 is an example of a backup member. The fixing device 10 heats the recording medium P, on which an unfixed toner image t has been formed, and fixes the unfixed toner image t to the recording medium P while transporting the recording medium P through the nip.

The heater 11 includes a substrate 111, a heat generating resistor 112 formed on the substrate 111, and a protective layer 113 that covers and protects the heat generating resistor 112. The substrate 111 is made of alumina or aluminum nitride. The heat generating resistor 112 is formed by screen-printing a silver-palladium alloy or the like on the substrate 111. The protective layer 113 is made of a pressure-resistant glass or the like.

A heat conductive member 30 is in contact with a surface of the heater 11 opposite to a surface that is in contact with the film 13. The material of the heat conductive member 30 may be a metal that has a higher heat conductivity than the substrate 111, such as aluminum, copper, or silver, or a graphite sheet. A flexible graphite sheet having a thickness of 100 μm or less may be used.

A thermistor 14, which is an example of a temperature detector, is disposed on a region of the surface of the heat conductive member 30 opposite to the surface that is in contact with the heater 11, the region corresponding to a sheet-passing area through which a recording medium passes. A controller 8 controls supply of electric power to the heat generating resistor 112 so that the temperature detected by the thermistor 14 becomes a target temperature. In the present embodiment, the heat generating resistor 112 has a resistance of 20Ω (720 W for an input of 120 V).

A support member 12 guides the inner surface of the film 13 while supporting the heater 11 via the heat conductive member 30. The support member 12 is made of a liquid crystal polymer, a phenolic resin, polyether sulfone (PPS), polyphenylene sulfide (PEEK), or the like. The film 13 is loosely fitted onto the support member 12 with a space therebetween, so that the film 13 can rotate in the direction indicated by an arrow.

The film 13, the heater 11, and the support member 12 are unitized into a film unit.

The pressure roller 20 includes a metal core 21, an elastic layer 22 formed around the metal core 21, and a release layer 24 formed around the elastic layer 22. A bonding layer 23 may be disposed between the elastic layer 22 and the release layer 24. The metal core 21 is made of a metal material, such as aluminum or iron. The elastic layer 22 is made by foaming a heat-resistant rubber, such as silicone rubber or fluorocarbon resin rubber. The release layer 24 is made by covering or coating a tube that is made of a fluorocarbon resin in which particles of a conductive agent, such as carbon or the like, are diffused. The bonding layer 23 is formed by applying an RTV silicone rubber to the outer surface of the elastic layer 22.

In the present embodiment, the pressure roller 20 has an outer diameter of 20 mm and a roller hardness of 48° (Asker-C 600 g weight); and the heatproof temperature of the pressure roller is 250° C.

The film unit is pressed against the pressure roller 20 at both ends thereof in the longitudinal direction by a pressing mechanism (not shown). The heater 11 forms a nip in cooperation with the pressure roller 20 with the film 13 therebetween. The nip has a width needed to perform a fixing operation. The pressure roller 20 is rotated in the direction indicated by an arrow in FIG. 2 by a driving source (not shown) via a driving member, such as a gear, disposed at an end of the metal core 21. As the pressure roller 20 is rotated, the film 13 is also rotated in the direction indicated by the arrow in FIG. 2.

Figure 3A:
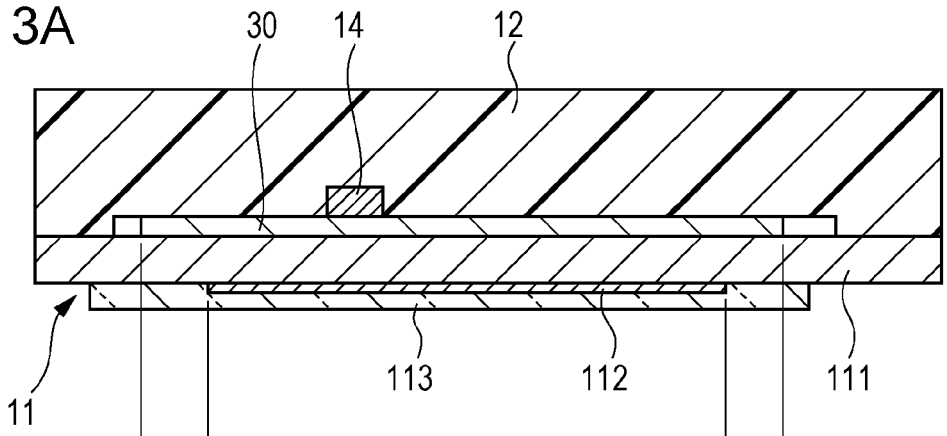
FIG. 3A illustrates how a support member, a heat conductive member, and a heater according to the first embodiment are stacked.
Figure 3B:
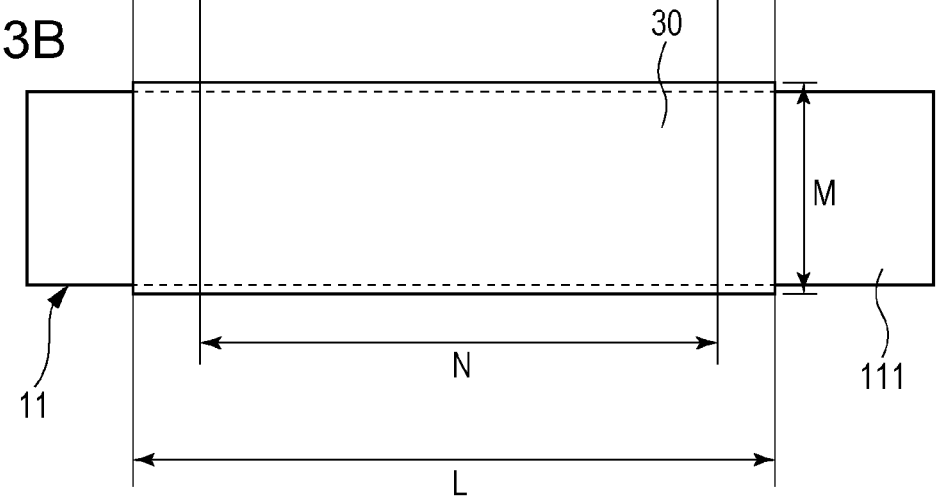
FIG. 3B illustrates the heater and the heat conductive member, which are seen from the support member side.

Next, referring to FIGS. 3A and 3B, the aluminum plate, which is an example of the heat conductive member 30 according to the present embodiment, and the positional relationship will be described. FIG. 3A illustrates how the heater 11, the heat conductive member 30, and the support member 12 are stacked; and FIG. 3B illustrates the heater 11 and the heat conductive member 30, which are seen from the support member 12 side. As illustrated in FIG. 3A, in the film unit, the heat conductive member 30 is disposed on the support member 12, and the heater 11 is disposed on the heat conductive member 30. The heater 11 is supported by the support member 12 at a middle portion thereof in the longitudinal direction via the heat conductive member 30. Moreover, the heater 11 is in contact with and supported by the support member 12 at end portions thereof in the longitudinal direction. As illustrated in FIGS. 3A and 3B, in the present embodiment, the substrate 111 has a rectangular-parallelepiped shape that has a length of 270 mm in the longitudinal direction, a width of 5.8 mm in the transverse direction, and a thickness of 1.0 mm. The length N of the heat generating resistor 112 in the longitudinal direction is 218 mm. The heat conductive member 30 has a thickness of 0.3 mm. The length L of a contact region of the heat conductive member 30 that is in contact with the heater 11 is 230 mm, and the width M of the contact region in the transverse direction is 5.9 mm. Accordingly, the heater 11 has a first region on which the heat generating resistor 112 is formed and a second region, located outside of the first region, on which the heat generating resistor 112 is not formed. The heat conductive member 30 is in contact with the heater 11 in a region extending across the first region and a part of the second region.

Figure 4:
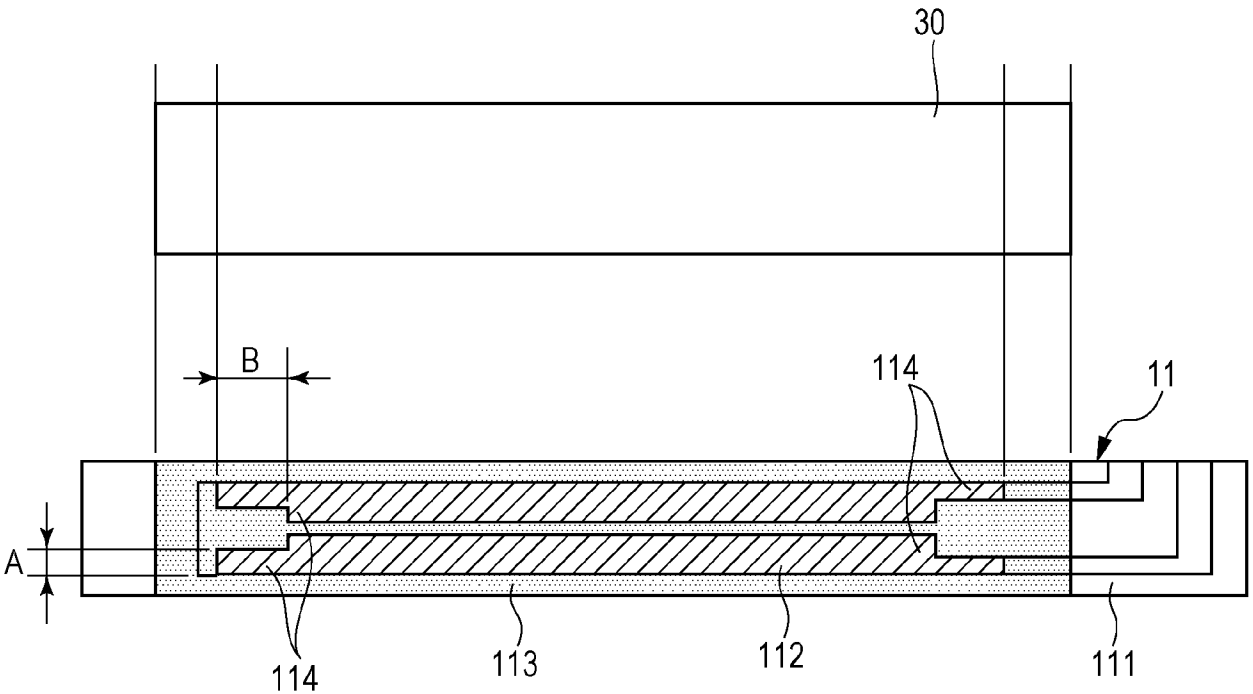
FIG. 4 illustrates the structure of the heater according to the first embodiment.

FIG. 4 illustrates the structures of the heater 11 and the heat generating resistor 112 according to the present embodiment. Referring to FIG. 4, the distribution of the amount of heat generated by the heater 11 in the longitudinal direction will be described. Each of end portions 114 of the heat generating resistor 112 in the longitudinal direction has a width smaller than that of a middle portion of the heat generating resistor 112, so that the electric resistance of each of the end portions per unit length is higher than that of the middle portion. The width of the middle portion of the heat generating resistor 112 in the transverse direction is 1.2 mm. The width A of each of the end portions is 1.0 mm. The length B of each of the end potions 114, whose width is small, is 4.0 mm. Accordingly, the amount of heat generated by each of the end portions of the heat generating resistor 112 is greater than that of the middle portion. Therefore, even with the structure including the heat conductive member 30, the end portion temperature decrease is suppressed and the end portion fixing performance is maintained. The distribution of the amount of heat generated by the heat generating resistor 112 in the longitudinal direction may be changed by changing the ratio of silver (Ag) to palladium (Pd) in the heat generating resistor or by changing the resistance density.

Next, specific examples will be described. Table 1 shows the result of evaluating the end portion fixing performance, the temperature rise of sheet-non-passing area, and the fixing performance when sheets are continuously passed, for the structures of comparative example 1, comparative example 2, and example 1, which will be described below.

Figure 5:
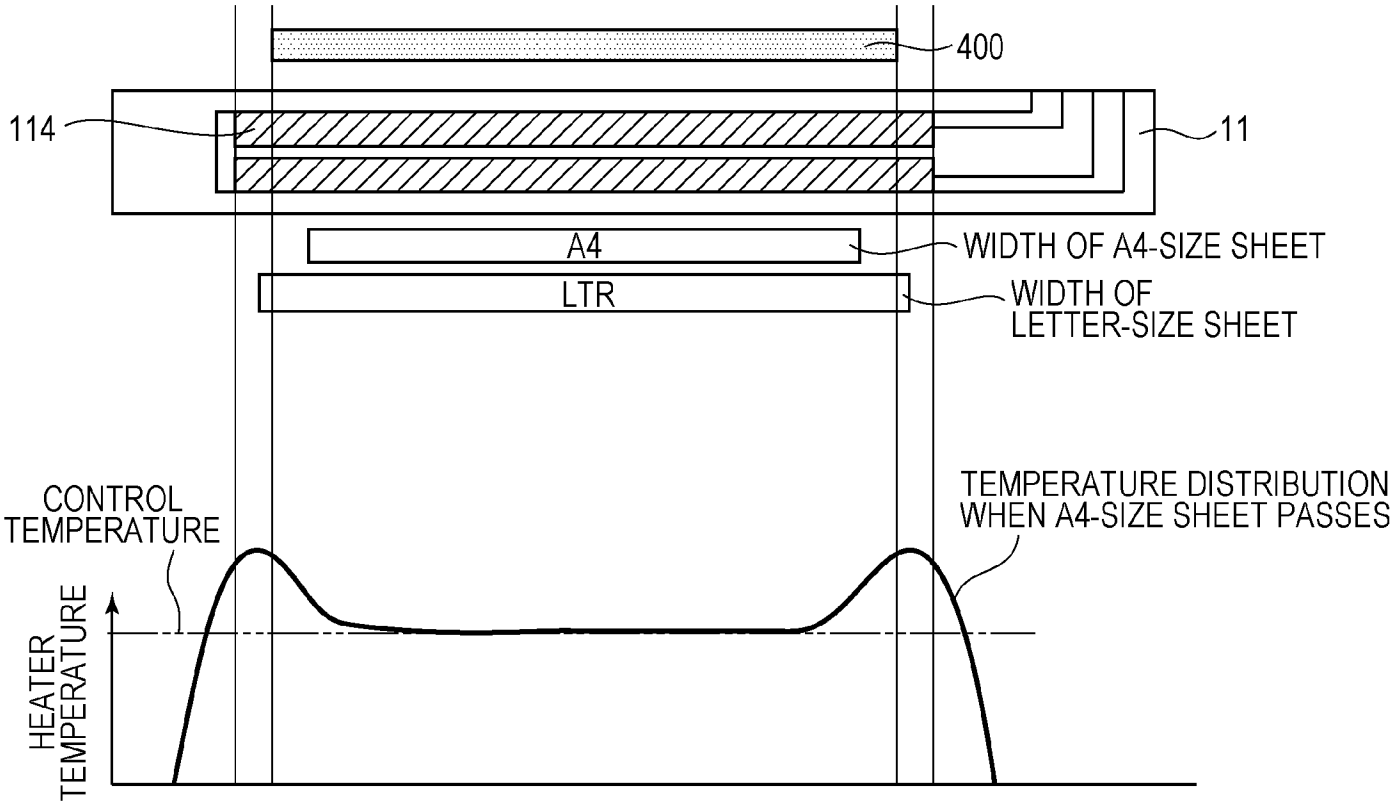
FIG. 5 illustrates the relationship between the length of a heater, the length of a heat conductive member, and the length of a recording medium according to comparative example 1 and the temperature distribution of the heater.
Figure 6:
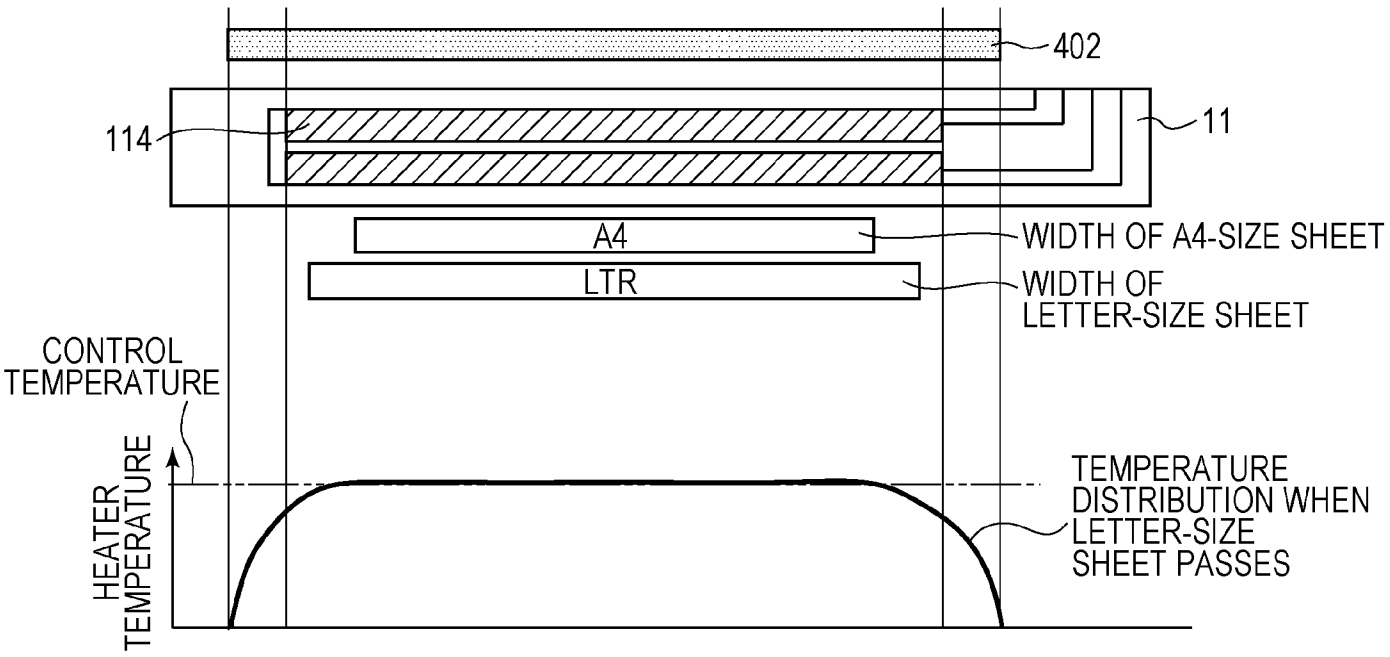
FIG. 6 illustrates the relationship between the length of a heater, the length of a heat conductive member, and the length of a recording medium according to comparative example 2 and the temperature distribution of the heater.
Figure 7:
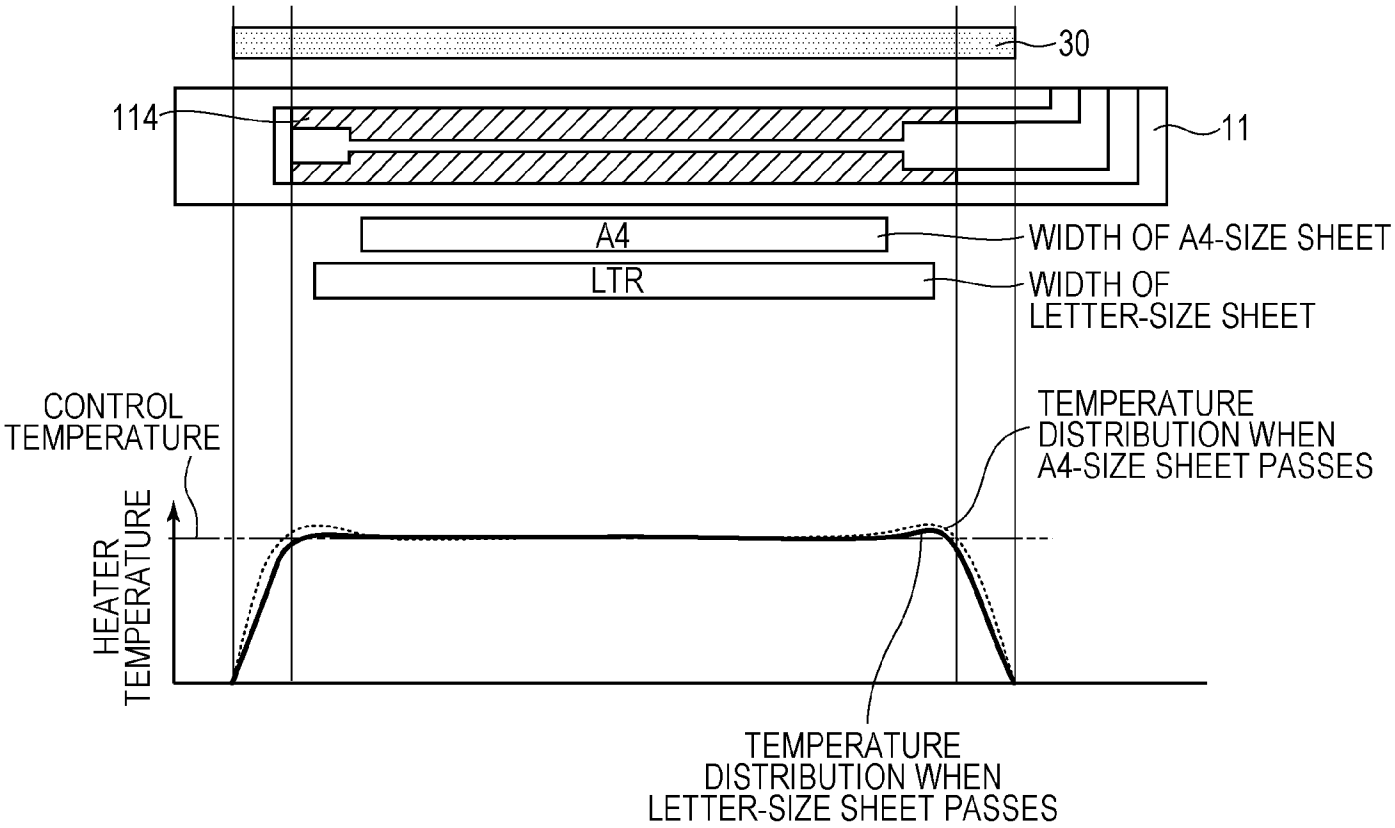
FIG. 7 illustrates the relationship between the length of the heater, the length of the heat conductive member, and the length of a recording medium according to example 1 and the temperature distribution of the heater.

In each of comparative example 1, comparative example 2, and example 1, an aluminum plate is sandwiched between the heater 11 and the support member 12. As illustrated in FIG. 5, in comparative example 1, the length L of an aluminum plate 400 is smaller than the length N of a heat generating resistor 114, and the distribution of the amount of heat generated by the heat generating resistor 114 of the heater 11 in the longitudinal direction is uniform. As illustrated in FIG. 6, in comparative example 2, the length L of an aluminum plate 402 is greater than the length of the heat generating resistor 114, and the distribution of the amount of heat generated by the heat generating resistor 114 of the heater 11 in the longitudinal direction is uniform. As illustrated in FIG. 7, in example 1, the length of the heat conductive member 30 is greater than the length of the heat generating resistor 112, and the amount of heat generated by end portions of the heat generating resistor 112 in the longitudinal direction is 120% of the amount of heat generated by the middle portion. In the longitudinal direction, the region on which the heat generating resistor 112 is disposed includes the entirety of a passing region through which a recording medium having the largest width that can be used in the fixing device (letter-size recording medium) passes. Moreover, ends of the heat generating resistor 112 are located outside of ends of the passing region of the recording medium having the largest width. Furthermore, the amount of heat generated by the heat generating resistor 112 at positions through which end portions of a recording medium having the largest width (letter-size recording medium) passes is greater than the amount of heat generated by the heat generating resistor 112 at positions through which end portions of a recording medium having the second largest width (A4-size recording medium) passes.

Next, the evaluation conditions will be described. The evaluation of the end portion fixing performance was performed by comparing recording media in which the degree of toner flaking at an end of an image was the worst when 200 sheets of Xx4200 (75 g/m$^2$, letter) were passed. As a test pattern, a pattern of 2d/3s horizontal lines was used. The evaluation of the temperature rise of sheet-non-passing area was performed by comparing the highest values of the surface temperature of the sheet-non-passing area of the pressure roller 20 when 200 sheets of Oce Red Label (80 g/m$^2$, A4) were passed. The evaluation of the fixing performance when sheets are continuously passed was performed by comparing the performance of fixing a halftone image (50%) on the 200th sheet when 200 sheets of Oce Red Label (80 g/m$^2$, A4) were passed.

These evaluations were performed under the following conditions: a temperature of 20° C., a humidity of 50%, a target temperature of 210° C., a process speed of 230 mm/sec, and a throughput of 40 pages/minute.

TABLE 1

| Structure | Length of Heat Generating Resistor | Length of Aluminum Plate | Amount of Heat Generated at End Portion of Heater | End Portion Fixing Performance | Temperature Rise of Sheet Non-Passing Area | Fixing Performance when Sheets are Continuously Passed |
|---|---|---|---|---|---|---|
| Comparative Example 1 | 218 mm | 214 mm | 100% | good | 240° C. | Bad |
| Comparative Example 2 | 218 mm | 230 mm | 100% | bad | 200° C. | Good |
| Example 1 | 218 mm | 230 mm | 120% | good | 210° C. | Good |

As shown in Table 1, in comparative example 1, although the end portion fixing performance was good, the surface temperature of an end portion of the pressure roller increased to 240° C. As a result, the effect of suppressing the temperature rise of sheet-non-passing area was not sufficient. Moreover, the fixing performance when sheets are continuously passed was not good. The mechanism behind such a result will be described below. The graph in the lower part of FIG. 5 shows the temperature distribution of the heater according to comparative example 1. With the structure of comparative example 1, when an A4-size recording medium, whose width is smaller than that of a letter-size recording medium, which is the largest width recording medium, the temperature of the sheet-non-passing area of the heater 11 becomes higher than the target temperature. However, because the length of the aluminum plate 400 of comparative example 1 is smaller than that of the heat generating resistor 114, heat of a part of a region of the heater 11 on which the heat generating resistor is formed and that is not in contact with the aluminum plate 400 does not easily flow through the aluminum plate 400. Therefore, the temperature rise of sheet-non-passing area is not sufficiently suppressed. Moreover, heat that has flowed from the part of the region of the heater 11, on which the heat generating resistor is formed and that is in contact with the aluminum plate 400, to the aluminum plate 400 easily flows to the sheet-passing area (inside area) of the aluminum plate 400 on which the thermistor 14 is disposed. When sheets are continuously passed through the fixing device, heat of the sheet-non-passing area continuously flows to the sheet-passing area, and the thermistor 14 detects that the temperature of the heater 11 has reached the target temperature. As a result, the controller erroneously reduces electric power supplied to the heater 11, and the amount of heat generated by the heater 11 falls short of the amount of heat absorbed by the recording medium. Consequently, the fixing performance is impaired.

In comparative example 2, the temperature rise of sheet-non-passing area and the fixing performance when sheets are continuously passed were good. However, the end portion fixing performance was not sufficient. The mechanism behind such a result will be described below. FIG. 6 illustrates the temperature distribution of the heater 11 according to comparative example 2 in the longitudinal direction. In comparative example 2, the length of the aluminum plate 402 is larger than that of the heat generating resistor 114. Therefore, the temperature of an end portion of an image formed on a letter-size recording medium tends to become lower than the target temperature. Accordingly, toner at the end portion of the image on the letter-size recording medium is not sufficiently melted, and toner flaking occurs at the end portion of the image. Toner flaking at an end portion of an image more likely occurs when printing is performed under a condition (cold condition) in which the temperature of the fixing device, including the aluminum plate 402, is near room temperature.

In example 1, the end portion fixing performance, the temperature rise of sheet-non-passing area, and the fixing performance when sheets are continuously passed were all good. The reason for this is considered as follows. As illustrated in FIG. 7, in example 1, the length of the heat conductive member 30 is greater than that of the heat generating resistor 112. Therefore, the temperature rise of sheet-non-passing area can be suppressed by dissipating heat of the sheet-non-passing area to both of the sheet-passing area (inside area) and the end portion (outside area). Moreover, because the amount of heat that flows from the sheet-non-passing area to the sheet-passing area, where the thermistor 14 is disposed, is reduced, the influence on the thermistor 14 is less than that of comparative example 1. Therefore, the fixing performance when sheets are continuously passed is not easily impaired. Furthermore, the amount of heat generated by the heat generating resistor 112 at its end portion is greater than that at its middle portion, and therefore the fixing performance can be maintained.

Accordingly, the fixing device according to the first embodiment has an advantage in that the fixing device can suppress temperature rise of sheet-non-passing area while maintaining the end portion fixing performance and in that the fixing device does not give great influence on the fixing performance when sheets are continuously passed.

The heater 11 according to the present embodiment includes only the heat generating resistor 112. However, the heater 11 may include two or more heat generating resistors that have different heat generation distributions, which can be changed by independently controlling the heat generating resistors. The heat conductive member 30 according to the present embodiment is longer than the heat generating resistor 112. However, the heat conductive member 30 may have the same length as the heat generating resistor, and the ends of the heat conductive member 30 in the longitudinal direction may be at the same positions as the ends of the heat generating resistor. Also in this case, the same advantage can be obtained.

Second Embodiment

The structure of the fixing device according to the present embodiment is the same as that of the first embodiment except for the aluminum plate. Therefore, descriptions of elements other than the aluminum plate will be omitted.

Figure 8A:
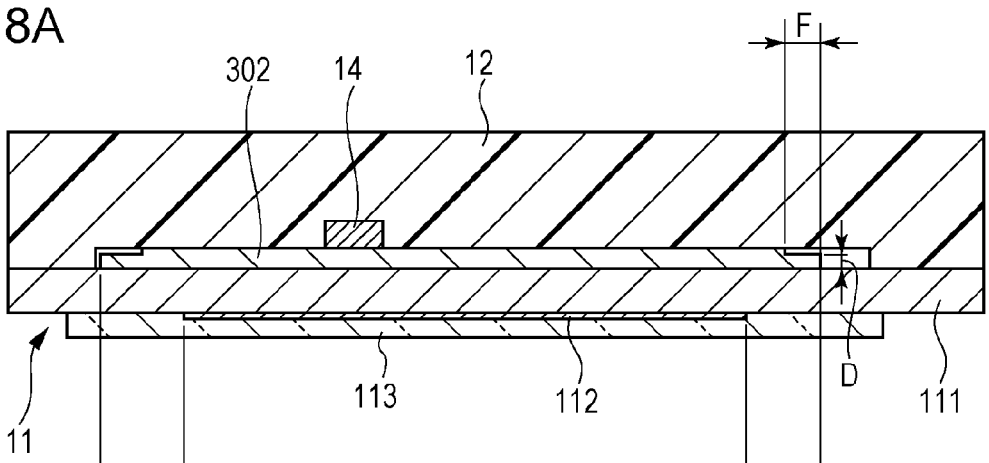
FIG. 8A illustrates how a support member, a heat conductive member, and a heater according to a second embodiment are stacked.
Figure 8B:
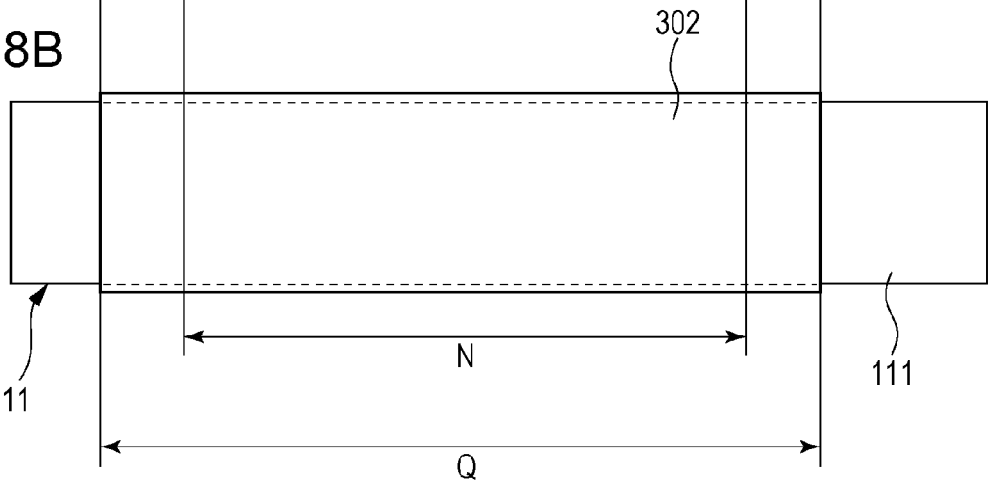
FIG. 8B illustrates the heater and the heat conductive member, which are seen from the support member side.

FIGS. 8A and 8B illustrate an aluminum plate 302 according to the present embodiment. FIG. 8A is a longitudinal sectional view; and FIG. 8B shows the positions of the heater 11, the heat generating resistor 112, and the aluminum plate 302 in the longitudinal direction. The aluminum plate 302 according to the present embodiment differs from the heat conductive member 30 according to the first embodiment in that the thickness of each end portion in the longitudinal direction is less than that of a middle portion in the longitudinal direction and in that the length of the end portion is increased from that of the heat conductive member 30 according to the first embodiment. The thickness D of the end portion of the aluminum plate 302 in the longitudinal direction is 0.1 mm. The length F of the end portion, having the thickness D, in the longitudinal direction is 20 mm. The entire length Q of the aluminum plate 302 is 260 mm. Table 2 shows the result of an experiment that was performed to examine the advantage of the present embodiment (example 2). The experimental conditions were the same as those of example 1.

TABLE 2

| Structure | Length of Heat Generating Resistor | Length of Aluminum Plate | Amount of Heat Generated at End Portion of Heater | End Portion Fixing Performance | Temperature Rise of Sheet Non-Passing Area | Fixing Performance when Sheets are Continuously Passed |
|---|---|---|---|---|---|---|
| Example 1 | 218 mm | 230 mm | 120% | GOOD | 210° C. | Good |
| Example 2 | 218 mm | 260 mm* | 120% | GOOD | 210° C. | Very Good |

(*Each end portion has a length of 20 mm and a thickness of 0.1 mm.)

With the structure of the present embodiment, regarding the end portion fixing performance and the temperature rise of sheet-non-passing area, an advantage equivalent to that of the first embodiment was obtained. In the second embodiment, the thickness of the end portion of the aluminum plate 302, whose length is larger than that of the first embodiment, is reduced. Therefore, the heat capacity of the end portion is not considerably different from that of the heat conductive member 30 of the first embodiment. Therefore, the end portion fixing performance is not impaired. Regarding the temperature rise of sheet-non-passing area, although the thermal contact resistance of the end portion of the aluminum plate 302 due to contact with the heater 11, having the thickness D, is increased, the amount of heat that flows out of the sheet-non-passing area does not considerably change, because the length of the end portion is increased. Thus, because heat of the sheet-non-passing area flows to the sheet-passing area (inside area) and the end portion (outside area) as in the first embodiment, the temperature rise of sheet-non-passing area is suppressed. A characteristic of the second embodiment is that the fixing performance when sheets are continuously passed is better than that of the first embodiment. The reason for this is that, because the length of the end portion of the aluminum plate 302 in the longitudinal direction is greater than that of the first embodiment, heat of the sheet-non-passing area more easily flows from the sheet-passing area to the end portion (outside area), which is further away from the sheet-passing area. In other words, because heat of the sheet-non-passing area flows to the end portion (outside), which is further away from the sheet-passing area, flow of heat into the sheet-passing area is suppressed.

Figure 9A:
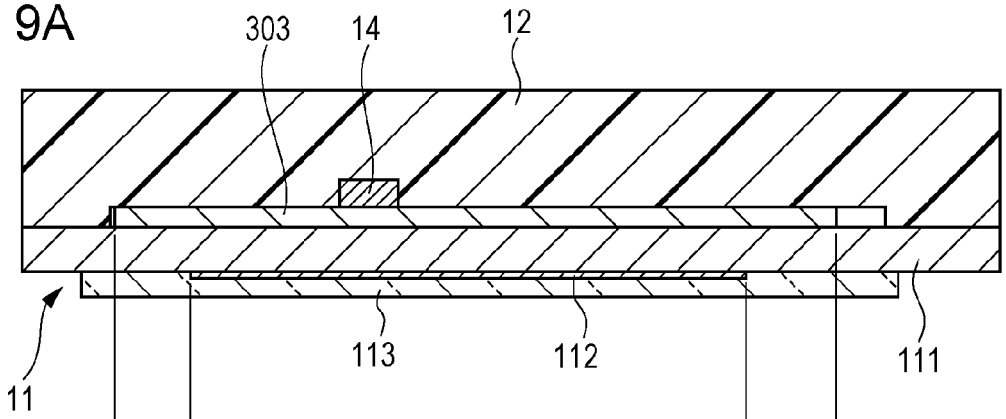
FIG. 9A illustrates how a support member, a heat conductive member, and a heater according to a modification of the second embodiment are stacked.
Figure 9B:
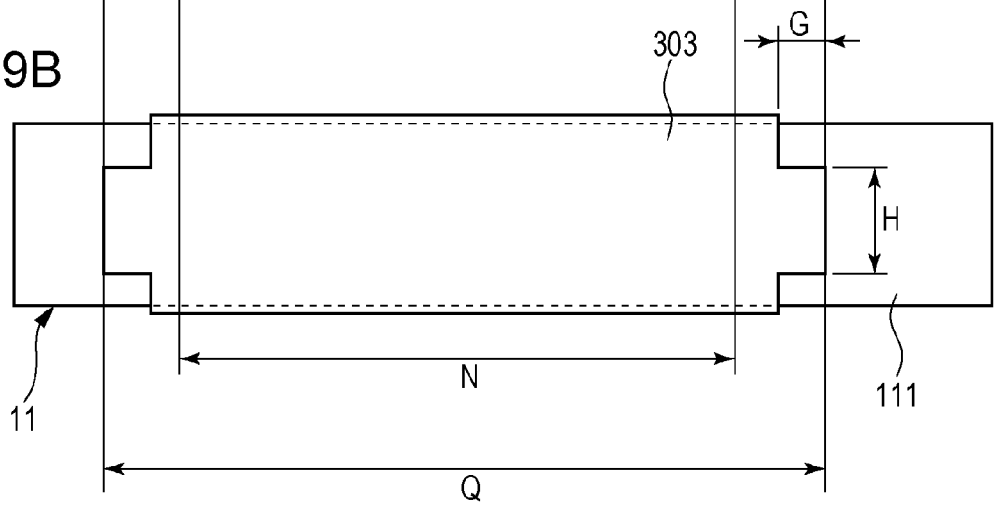
FIG. 9B illustrates the heater and the heat conductive member according to the modification of the second embodiment, which are seen from the support member side.

As a modification of the second embodiment, an aluminum plate 303 may be used in which the thickness of each end portion in the longitudinal direction is reduced and the width of the end portion is reduced. FIGS. 9A and 9B illustrate the structure of the present modification. FIG. 9A is a longitudinal sectional view; and FIG. 9B shows the positions of the heater 11, the heat generating resistor 112, and the aluminum plate 303 in the longitudinal direction. The width of a middle portion of the aluminum plate 303 in the present modification is 5.9 mm, and the width H of each end portion in the longitudinal direction is 5.3 mm. The length of the end portion, whose width is 5.3 mm, is 20 mm in the longitudinal direction. The entire length Q of the aluminum plate 303 is 260 mm. The present modification not only has an advantage equivalent to that of the second embodiment but also has an advantage in that the cost of the aluminum plate is lower than that of the second embodiment because the thickness of the aluminum plate is uniform.

As described above, the second embodiment and the modification of the second embodiment not only have an advantage in that the temperature rise of sheet-non-passing area can be suppressed while maintaining the end portion fixing performance as in the first embodiment but also have an advantage in that the fixing performance when sheets are continuously passed can be made better than that of the first embodiment.

In the first and second embodiments, the heater is in contact with the inner surface of the film and forms a transport nip, for transporting a recording medium, in cooperation with the backup member. However, it is not necessary that the heater, which is in contact with the inner surface of the film, form a transport nip. Alternatively, the backup member may form a transport nip in cooperation with a nip forming member that is different from the heater and that is in contact with the inner surface of the film. The heater may be an external heater that is in contact with an outer surface of the film, and the backup member may form a transport nip in cooperation with a nip forming member that is in contact with the inner surface of the film.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-054180, filed Mar. 17, 2014, which is hereby incorporated by reference herein in its entirety.

What is claimed is:

1. A fixing device that fixes a toner image on a recording medium by heating the toner image while conveying the recording medium bearing the toner image at a nip, the fixing device comprising:

a tubular film;

a heater, including an elongate substrate and a heat generating resistor formed on the substrate, configured to contact the film, the heater having a first region on which the heat generating resistor is formed and a second region, located outside of the first region in a longitudinal direction of the substrate, on which the heat generating resistor is not formed; and a heat conductive member configured to contact a surface of the heater opposite to a surface of the heater that contacts the film, the heat conductive member having a heat conductivity higher than that of the substrate, wherein the heat conductive member contacts the heater in a region extending across the first region and the second region, and wherein an amount of heat generated by the heat generating resistor at an end portion thereof is greater than an amount of heat generated at a middle portion thereof in the longitudinal direction.

2. The fixing device according to claim 1, further comprising:

a backup member that forms the nip with the heater via the film, wherein the heater contacts an inner surface of the film.

3. The fixing device according to claim 1, wherein the first region includes, in the longitudinal direction, an entirety of a passing region through which a recording medium, having a largest width that can be used in the fixing device, passes, and wherein an end of the first region in the longitudinal direction is located outside of an end of the passing region.

4. The fixing device according to claim 1, wherein an amount of heat generated by the heat generating resistor at a position corresponding to an end of a recording medium, having a largest width that can be used in the fixing device, is greater than an amount of heat generated by the heat generating resistor at a position corresponding to an end of a recording medium having a second largest width that can be used in the fixing device.

* * * * *